US006745734B2

(12) United States Patent
Pierik

(10) Patent No.: US 6,745,734 B2
(45) Date of Patent: Jun. 8, 2004

(54) VARIABLE VALVE ACTUATING MECHANISM HAVING TORSIONAL LASH CONTROL SPRING

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/320,261

(22) Filed: Dec. 16, 2002

(65) Prior Publication Data

US 2003/0217715 A1 Nov. 27, 2003

Related U.S. Application Data

(60) Provisional application No. 60/383,016, filed on May 24, 2002.

(51) Int. Cl.[7] ..... F01L 1/34

(52) U.S. Cl. ..... 123/90.16; 123/90.17; 123/90.15; 123/90.31

(58) Field of Search ..... 123/90.15–90.17, 123/90.27, 90.31, 90.44, 90.65

(56) References Cited

U.S. PATENT DOCUMENTS 5,937,809 A * 8/1999 Pierik et al. ..... 123/90.16
6,019,076 A * 2/2000 Pierik et al. ..... 123/90.16

* cited by examiner

*Primary Examiner*—Thomas Denion
*Assistant Examiner*—Kyle Riddle
(74) *Attorney, Agent, or Firm*—Patrick M. Griffin

(57) ABSTRACT

A variable valve actuating mechanism includes an output cam pivotally disposed upon an input shaft of an engine. First and second frame members are disposed upon the input shaft on respective sides of the input cam lobe. A first link arm is pivotally coupled at a first end thereof to the first and second frame members. A rocker arm assembly is pivotally coupled at a first end thereof to a second end of the link arm. The rocker arm assembly carries a cam follower that engages an input cam lobe of the input shaft. A biasing means is grounded to the first and second frame members, and biases the cam follower into engagement with the input cam lobe.

21 Claims, 6 Drawing Sheets

VARIABLE VALVE ACTUATING MECHANISM HAVING TORSIONAL LASH CONTROL SPRING

CROSS-REFERENCE TO RELATED APPLICATIONS

This application claims the benefit of U.S. Provisional Patent Application No. 60/383,016, filed May 24, 2002.

TECHNICAL FIELD

The present invention relates to a variable valve actuating mechanism. More particularly, the present invention relates to a variable valve actuating mechanism having a torsional lash control spring.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing, duration and/or lift (i.e., the valve lift profile) of the cylinder valves in response to engine operating parameters, such as engine load, speed, and driver input. Intake valve throttle control systems vary the valve lift profile through the use of variously-configured mechanical and/or electromechanical devices, collectively referred to herein as variable valve actuation (VVA) mechanisms. Several examples of particular embodiments of VVA mechanisms are detailed in commonly assigned U.S. Pat. No. 5,937,809 and U.S. Pat. No. 6,019,076, the disclosures of which are incorporated herein by reference.

Generally, a conventional VVA mechanism includes a rocker arm that carries an input cam follower, such as a roller. The input cam follower engages an opening or input cam lobe of a rotating input shaft, such as the engine camshaft, and transfers rotation of the input cam lobe to oscillation of the rocker arm toward and away from the input shaft in a generally radial direction. The oscillation of the rocker arm is transferred via a link arm to pivotal oscillation of an output cam relative to the input shaft. The pivotal oscillation of the output cam is transferred to actuation of an associated valve by an output cam follower, such as, for example, a roller finger follower.

A desired valve lift profile is obtained by pivoting a control shaft into a predetermined angular orientation relative to a centerline thereof. A frame member of the VVA mechanism is pivotally disposed on the input shaft, and is coupled at one end thereof to the control shaft and at the other end thereof to the rocker arm. The pivotal movement of the control shaft is transferred, via the frame member, rocker arm and link arm, to pivotal movement of the output cam relative to a central axis of the input shaft. Thus, pivoting the control shaft places the output cam into the base or starting angular orientation. The base or starting angular orientation of the output cam, in turn, determines the portion of the lift profile thereof that will engage the output cam follower during pivotal oscillation of the output cam. The lift profile of the output cam that engages the cam follower determines the valve lift profile.

The rocker arm may carry a closing cam follower, such as, for example, a slider pad, that engages a closing cam lobe of the rotary input shaft. The closing cam lobe follows or lags the opening cam lobe. The closing cam follower transfers rotation of the closing cam lobe to the rocker arm, thereby ensuring that the output cam is pivoted back or returned to its starting or base angular orientation. Adding a closing cam to the camshaft of an engine, however, requires a redesigned camshaft and adds substantial complexity to the manufacture of, and thus adds cost to, the camshaft.

Alternatively, a biasing means, such as, for example, a spring, may be incorporated that biases the output cam back to the starting or base angular orientation. Such VVA mechanism are sometimes referred to as spring-based VVA mechanisms. The biasing means, typically referred to as a return or lash spring, engages, for example, the rocker or link arm of the VVA mechanism in such a way that the spring is compressed as the output cam is oscillated counterclockwise from its starting position during actuation of the associated valve, and is expanded or decompressed during the closing of the associated valve. The expansion or decompression force of the spring pivots the output cam back to the starting or base angular position.

Springs, however, have a natural frequency or mode of vibration that is often referred to as spring surge. The operational frequency of a VVA mechanism that utilizes a return spring is limited to a maximum of approximately eight to ten times less than the natural frequency of the return spring. This limited maximum operational frequency of the VVA undesirably limits the maximum engine speed at which variable valve timing can be utilized. Further, the utilization of lash/return springs in VVA mechanisms limits the reliability of the mechanisms.

Therefore, what is needed in the art is a spring-based VVA mechanism that includes a lash or return spring and has an increased maximum operational frequency relative to other spring-based VVA mechanisms.

Furthermore, what is needed in the art is a spring-based VVA mechanism having increased reliability.

SUMMARY OF THE INVENTION

The present invention provides a spring-based variable valve actuation mechanism.

The present invention comprises, in one form thereof, output cams pivotally disposed upon an input shaft of an engine. First and second frame members are disposed upon the input shaft on respective sides of an input cam lobe of the input shaft. A link arm is pivotally coupled at a first end thereof to the output cams. A rocker arm assembly is pivotally coupled at a first end thereof to a second end of the link arm. The rocker arm assembly carries a cam follower that engages the input cam lobe of the input shaft. A biasing means is grounded to the first and second frame members, and biases the cam follower into engagement with the input cam lobe.

An advantage of the present invention is that the maximum operational speed of the VVA mechanism is increased relative to other spring-based VVA mechanisms.

A further advantage of the present invention is that the reliability of the VVA mechanism is improved over conventional spring-based mechanisms.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
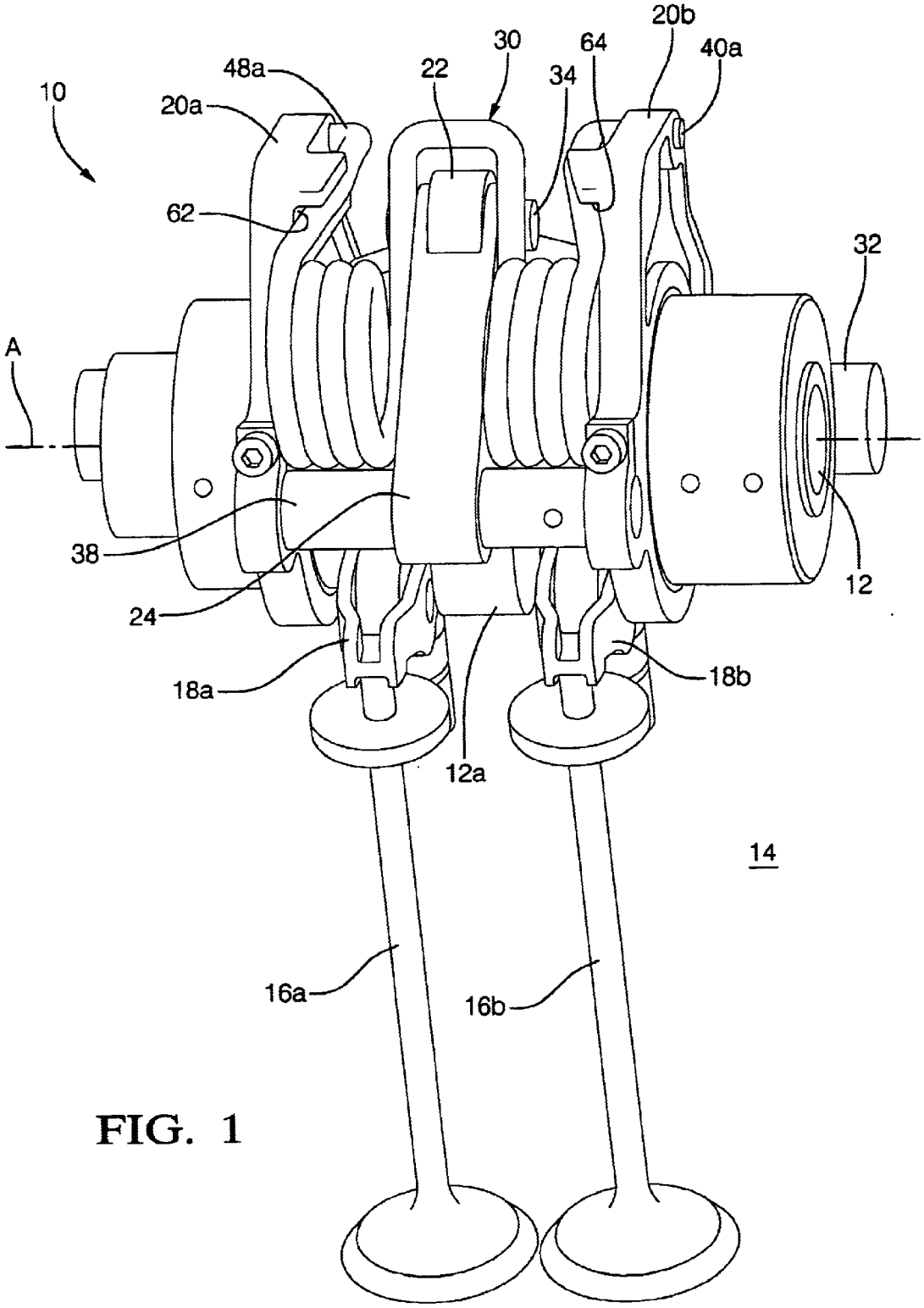
FIG. 1 is a perspective, front view of one embodiment of a variable valve actuating (VVA) mechanism of the present invention.
Figure 2:
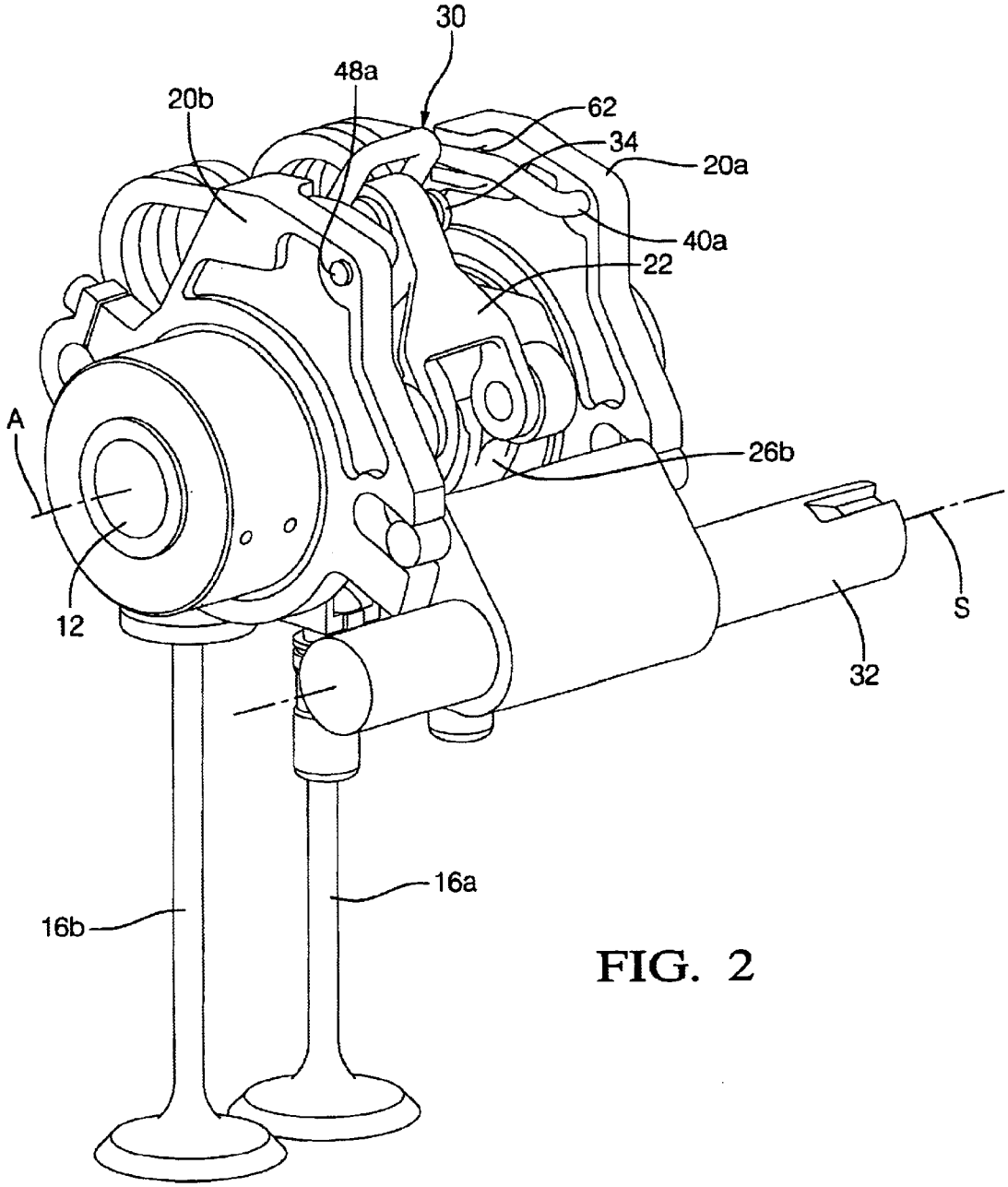
FIG. 2 is a perspective rear/side view of the VVA mechanism of FIG. 1.

Referring to the drawings, and particularly to FIGS. 1 and 2, there is shown one embodiment of a variable valve actuating (VVA) mechanism of the present invention.

VVA mechanism 10, as is known in the art, is operably associated with rotary input shaft or camshaft 12 of engine 14. Camshaft 12 has a central axis A, and includes an input cam lobe 12*a* that rotates with camshaft 12. Valves 16*a* and 16*b* are associated with a cylinder (not shown) of engine 14 and with respective cam followers 18*a* and 18*b*, such as, for example, roller finger followers.

Figure 3:
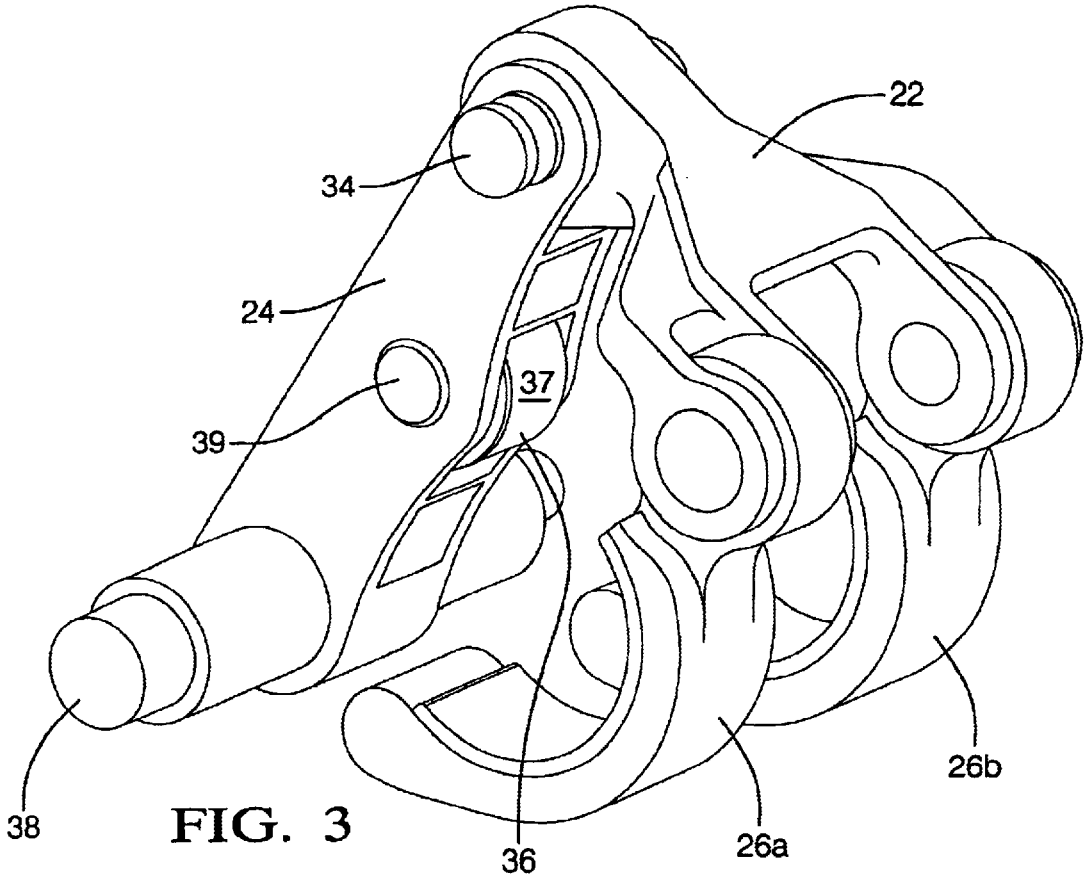
FIG. 3 is a perspective view of the rocker arm assembly, link arm and output cams of the VVA mechanism of FIG. 1.

VVA mechanism 10 includes frame members 20*a* and 20*b*, link arm 22, rocker arm assembly 24, output cams 26*a* and 26*b* (FIG. 2 and FIG. 3), and lash or return spring 30. Generally, VVA mechanism 10 transfers rotation of input cam lobe 12*a* of camshaft 12 to pivotal oscillation of output cams 26*a* and 26*b* to thereby actuate valves 16*a* and 16*b* according to a desired valve lift profile.

Frame members 20*a* and 20*b* are pivotally disposed on camshaft 12 on respective and opposite sides of input cam lobe 12*a*. Frame members 20*a* and 20*b*, as will be more particularly described hereinafter, are pivotally coupled at one end (not referenced) thereof by spring 30 to rocker arm assembly 24, and at an opposite end (not referenced) thereof to control shaft 32 by coupling means (not referenced), such as, for example, shaft clamps or pins.

Link arm 22 is an elongate arm member having a first end (not referenced) that is pivotally coupled to rocker arm assembly 24 by link-to-rocker pin 34. Link arm 22 at a second end thereof is forked, with each of the forks (not referenced) being pivotally coupled, such as, for example, by respective pins (not referenced), to a respective one of output cams 26*a* and 26*b*.

Rocker arm assembly 24 is pivotally coupled at a first end (not referenced) thereof to link arm 22 by link-to-rocker pin 34. Rocker arm assembly 24 carries an input cam follower 36 (FIG. 3), such as, for example, a roller 37, rotatably coupled to rocker arm assembly 24 by roller pin 39. Roller 37 engages input cam 12*a*. At a second end (not referenced) thereof, rocker arm assembly 24 is pivotally coupled to frame members 20*a* and 20*b* by eccentric rocker-to-frame pin 38.

Rocker-to-frame pin 38 is an elongate pin or shaft member that is pivotally coupled to and extends between each of frame members 20*a* and 20*b*. Generally, pivoting eccentric rocker-to-frame pin 38 about its central axis (not referenced) provides relatively small and/or fine adjustments in the amount of valve lift imparted to the valves by VVA mechanism 10. Thus, pivoting rocker-to-frame pin 38 of one or more VVA mechanisms 10 enables the adjustment and/or matching of valve lifts between two or more cylinders.

Output cams 26*a* and 26*b* are pivotally disposed upon camshaft 12. More particularly, output cam 26*a* is pivotally disposed upon camshaft 12 on a first side of input cam lobe 12*a* and between input cam lobe 12*a* and frame member 20*b*, whereas output cam 26*b* is disposed on a second side of input cam lobe 12*a* and between input cam lobe 12*a* and frame member 20*a*. Output cams 26*a* and 26*b* are pivotally coupled to rocker arm assembly 24 as described above.

Figure 4:
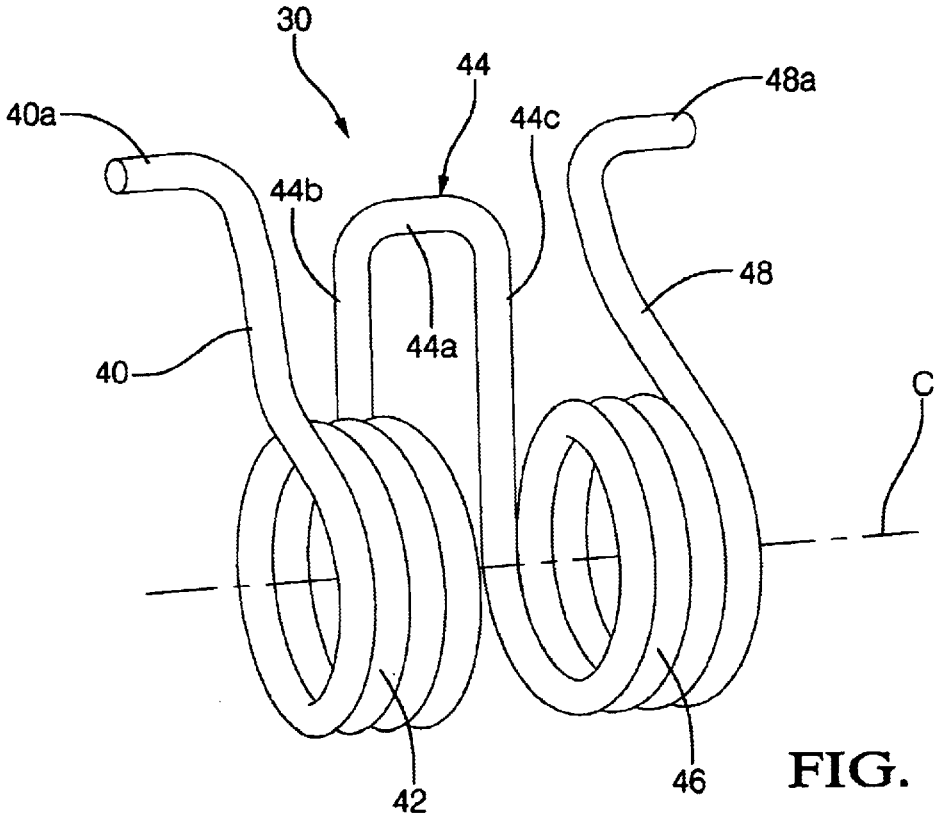
FIG. 4 is a perspective view of the lash/return spring of the VVA mechanism of FIG. 1.

Lash/return spring 30, as best shown in FIG. 4, includes a first arm section 40, a first coil section 42, a central arm section 44, a second coil section 46 and a second arm section 48. First and second coil sections 42, 46, respectively, are generally concentric relative to central axis C. First arm section 40 extends in a generally tangential direction from an outer end of first coil section 42, and includes end 40*a* that extends in a direction away from central arm section 44 and in a generally parallel manner relative to central axis C. Central arm section 44 interconnects first coil section 42 and second coil section 46, and includes bridge section 44*a* and central leg sections 44*b* and 44*c*. More particularly, bridge section 44*a* is generally parallel relative to central axis C, and is connected to first and second coil sections 42 and 44 by central leg sections 44*b* and 44*c*, respectively. Second arm section 48 extends in a generally tangential direction from an outer end of second coil section 46, and includes end 48*a* that extends in a direction away from central arm section 44 and in a generally parallel manner relative to central axis C of first and second coil sections 42 and 46, respectively.

Figure 5:
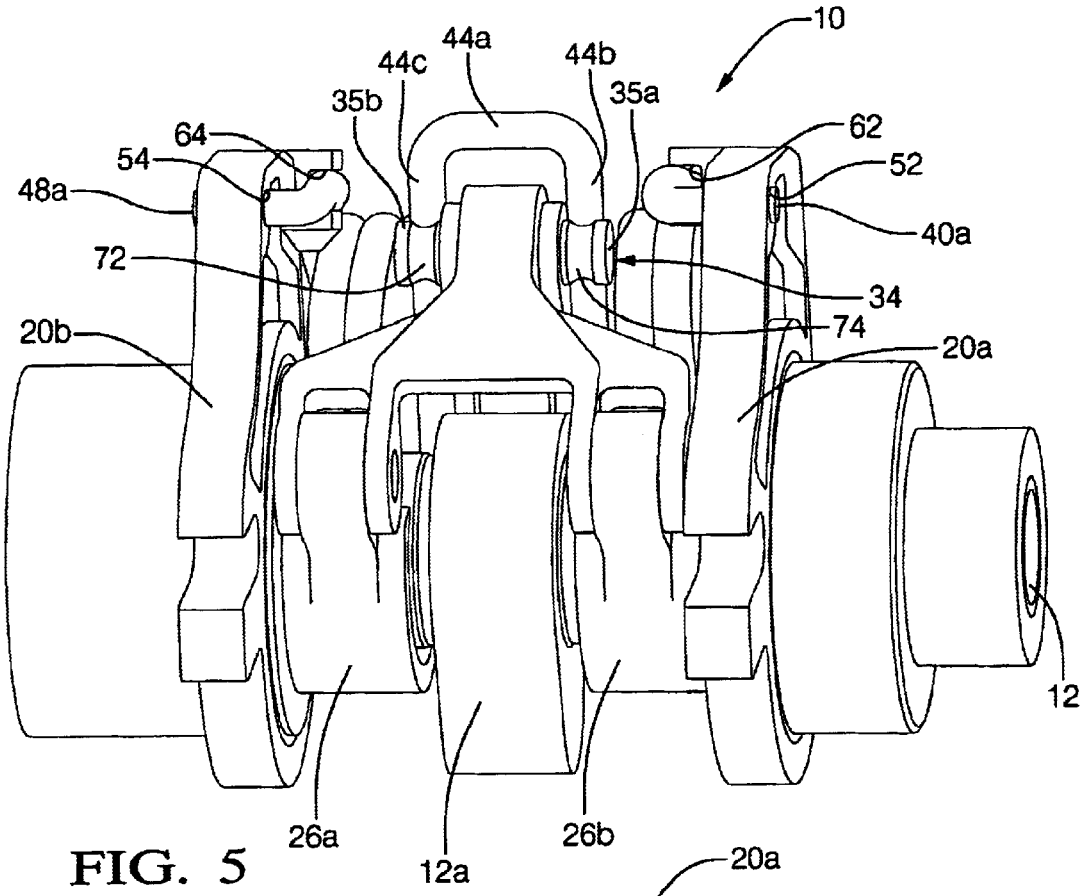
FIG. 5 is a perspective rear view of the VVA mechanism of FIG. 1 with the control shaft omitted for clarity.
Figure 6:
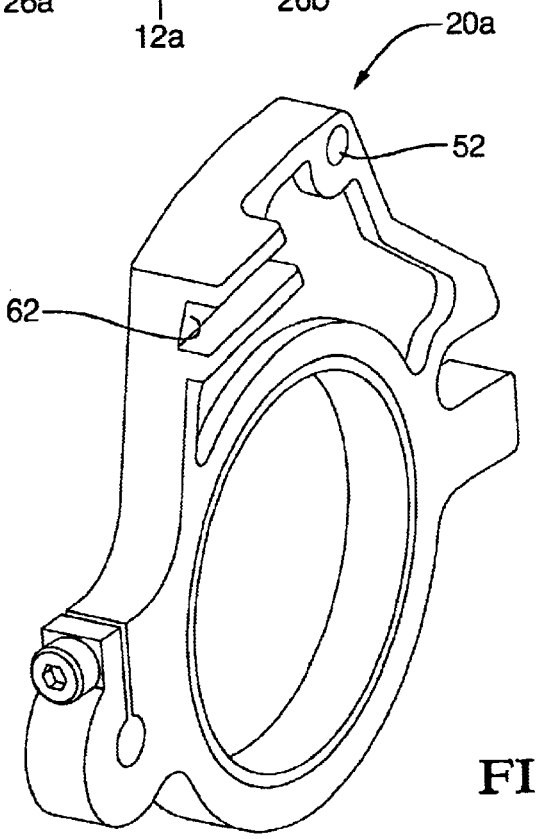
FIG. 6 is a perspective view of one of the frame members of the VVA mechanism of FIG. 1.

End 40*a* of first arm section 40 and end 48*a* of second arm section 48 are grounded to frame members 20*a* and 20*b*, respectively. More particularly, as best shown in FIGS. 5 and 6, end 40*a* is disposed within orifice 52 in frame member 20*a*, thereby grounding end 40*a*. Similarly, end 48*a* is disposed within orifice 54 in frame member 20*b*, thereby grounding end 48*a*. The grounding of ends 40*a* and 48*a* as described above substantially precludes movement of lash/return spring 30 in a direction generally parallel relative to central axis A of VVA mechanism 10.

Lash/return spring 30 is further grounded to frames 20*a*, 20*b* by slots 62 and 64 (FIGS. 5 and 6) formed in frames 20*a*, 20*b*, respectively. More particularly, the portion of first arm section 40 proximate end 40*a* is disposed within slot 62 in frame member 20*a*. Similarly, the portion of second arm section 48 proximate end 48*a* is disposed within slot 64 in frame member 20*b*. Slots 62, 64, in part, preclude the rotation of lash/return spring 30 relative to frame members 20*a*, 20*b*.

It should be particularly noted that frame members 20*a* and 20*b* are substantially mirror images of each other, and are configured for being disposed on opposite sides of input cam lobe 12*a*. FIG. 6 shows a perspective view of only frame member 20*a*, and it is to be understood that frame member 20*b* is a mirror image thereof, and is thus configured for being disposed on the opposite side of input cam lobe 12*a*.

Generally, lash/return spring 30 biases, directly or indirectly, rocker arm assembly 24 in a direction toward input cam lobe 12*a* such that input cam follower 36 remains in contact with input cam lobe 12*a* during rotation thereof. More particularly, and as best shown in FIG. 5, leg sections 44*b* and 44*c* engage corresponding ends of link-to-rocker pin 34. Link-to-rocker pin 34 is an elongate link-to-rocker pin, and includes pin ends 35*a,b* that extend laterally beyond or outside of the interface of link arm 22 with rocker arm assembly 24 and which are thus disposed on opposite sides of link arm 22 and/or rocker arm assembly 24. The pin ends of link-to-rocker pin 34 define respective grooves 72 and 74 around at least a portion of the circumference or periphery thereof, and in which a segment of leg portions 44*c* and 44*b*, respectively, are disposed.

In use, and in general, VVA mechanism 10 converts rotation of camshaft 12 to a fixed range of pivotal oscillation of output cams 26*a* and 26*b* relative to central axis A. More particularly, input cam follower 36 carried by rocker arm 24 is biased into engagement with input cam lobe 12*a* of camshaft 12 by lash/return spring 30. Rotation of input cam lobe 12*a* from a low lift orientation towards and/or into a high-lift orientation displaces rocker arm 24 in a generally radial direction away from central axis A. The displacement of rocker arm 24 away from central axis A is transferred via link arm 22 to pivotal movement of output cams 26*a* and 26*b* relative to central axis A of camshaft 12. Leg sections 44*b*,44*c* of lash/return spring 30 engage the ends 35*a,b* of link-to-rocker pin 34, and thus moves with rocker arm 24. The displacement of rocker arm 24 away from central axis A is therefore transferred to compression of lash/return spring 30.

As input cam lobe 12*a* rotates from a high-lift orientation back toward and/or into a low lift or base circle orientation, lash/return spring 30 expands and exerts a force against rocker arm assembly 24 via link-to-rocker pin 34, thereby maintaining the input cam follower 36 carried by rocker arm 24 in contact with input cam lobe 12*a*. The expansion of lash spring 30 displaces rocker arm 24 in a generally radial direction toward central axis A of camshaft 12, thereby pivoting (via link arm 22) output cams 26*a* and 26*b* back to their base or starting angular orientation.

A desired valve lift profile for valves 16*a*, 16*b* is obtained by placing control shaft 32 in a predetermined angular orientation relative to central axis S (FIG. 2) thereof. The pivoting of control shaft 32 is transferred to frame members 20*a*, 20*b*, and via rocker arm 24 and link arm 22 to pivoting of output cams 26*a* and 26*b* relative to central axis A of camshaft 12. Thus, a desired portion of the lift profiles of output cams 26*a* and 26*b* are disposed within the pivotal oscillatory range thereof relative to output cam followers 18*a*, 18*b*. As output cams 26*a*, 26*b* are pivotally oscillated, the desired portions of the lift profiles thereof engage output cam followers 18*a*, 18*b* to thereby actuate valves 16*a* and 16*b* according to a desired lift profile.

Figure 7:
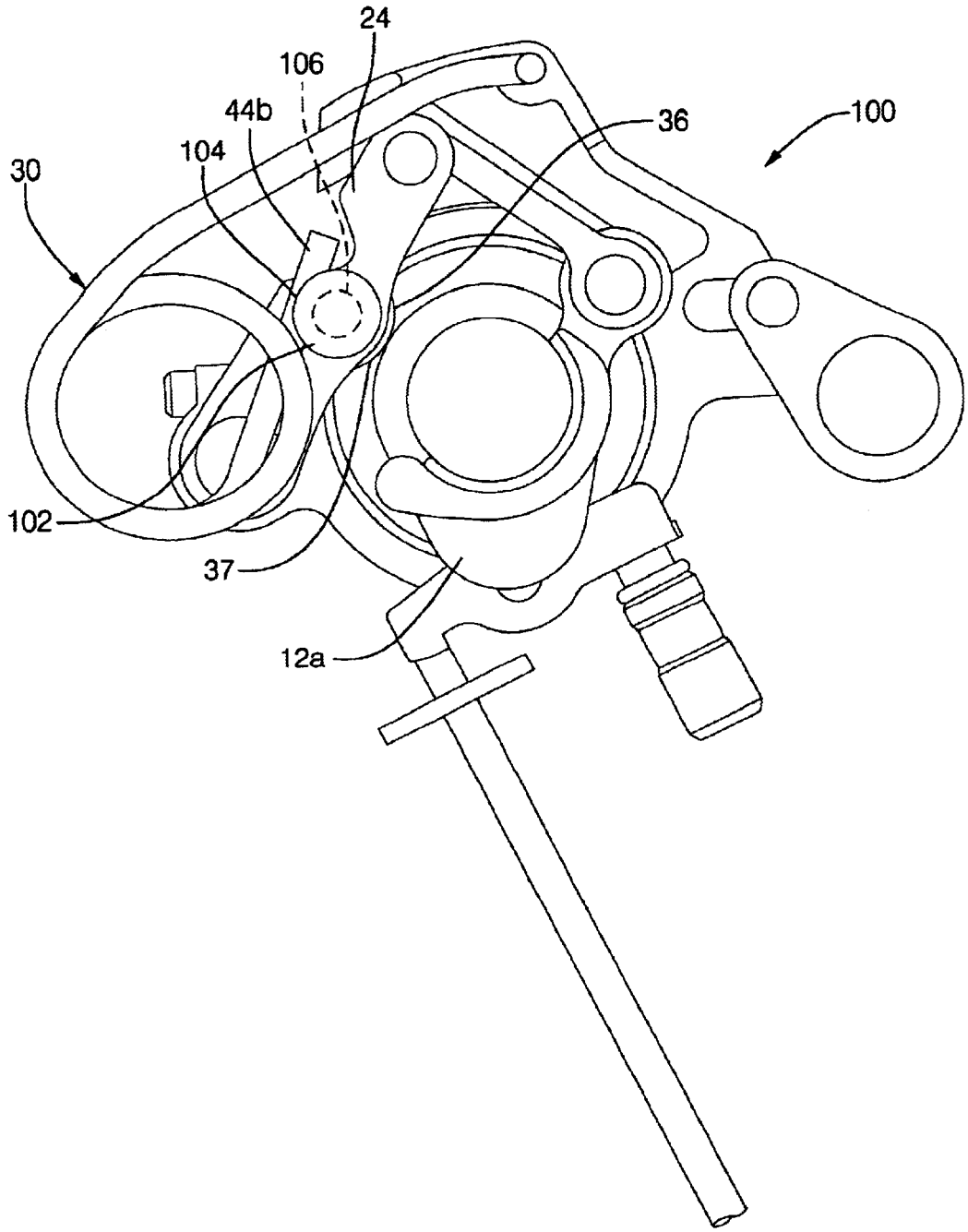
FIG. 7 is a perspective view of a second embodiment of the VVA mechanism of the present invention.

Referring now to FIG. 7, a second embodiment of a variable valve mechanism of the present invention is shown. VVA 100 is generally similar to VVA 10. In this embodiment, however, lash/return spring 30 engages roller pin 102 to bias rocker arm assembly 24 in a direction toward, and thus maintain roller 37 of cam follower 36 in contact with, input cam lobe 12*a*. Roller pin 102 pivotally couples cam follower 36 to rocker arm assembly 24. Similar to link-to-rocker pin 34, roller pin 102 is an elongate pin member, and includes pin ends (not referenced) that extend laterally beyond or outside of rocker arm assembly 24 and which are thus disposed on opposite sides of rocker arm assembly 24. Similar to link-to-rocker pin 34, the pin ends of roller pin define respective grooves, shown as phantom line 106 in FIG. 7, around at least a portion of the circumference or periphery thereof, and in which a segment of leg portions 44*b* and 44*c* of lash/return spring 30 are disposed. The engagement of roller pin 102 by lash/return spring 30 transfers the biasing force of spring 30 substantially directly to cam follower 36. Thus, rocker arm assembly 24 is subjected to less force, and can therefore be made lighter or constructed of a more lightweight and less expensive material.

Figure 8:
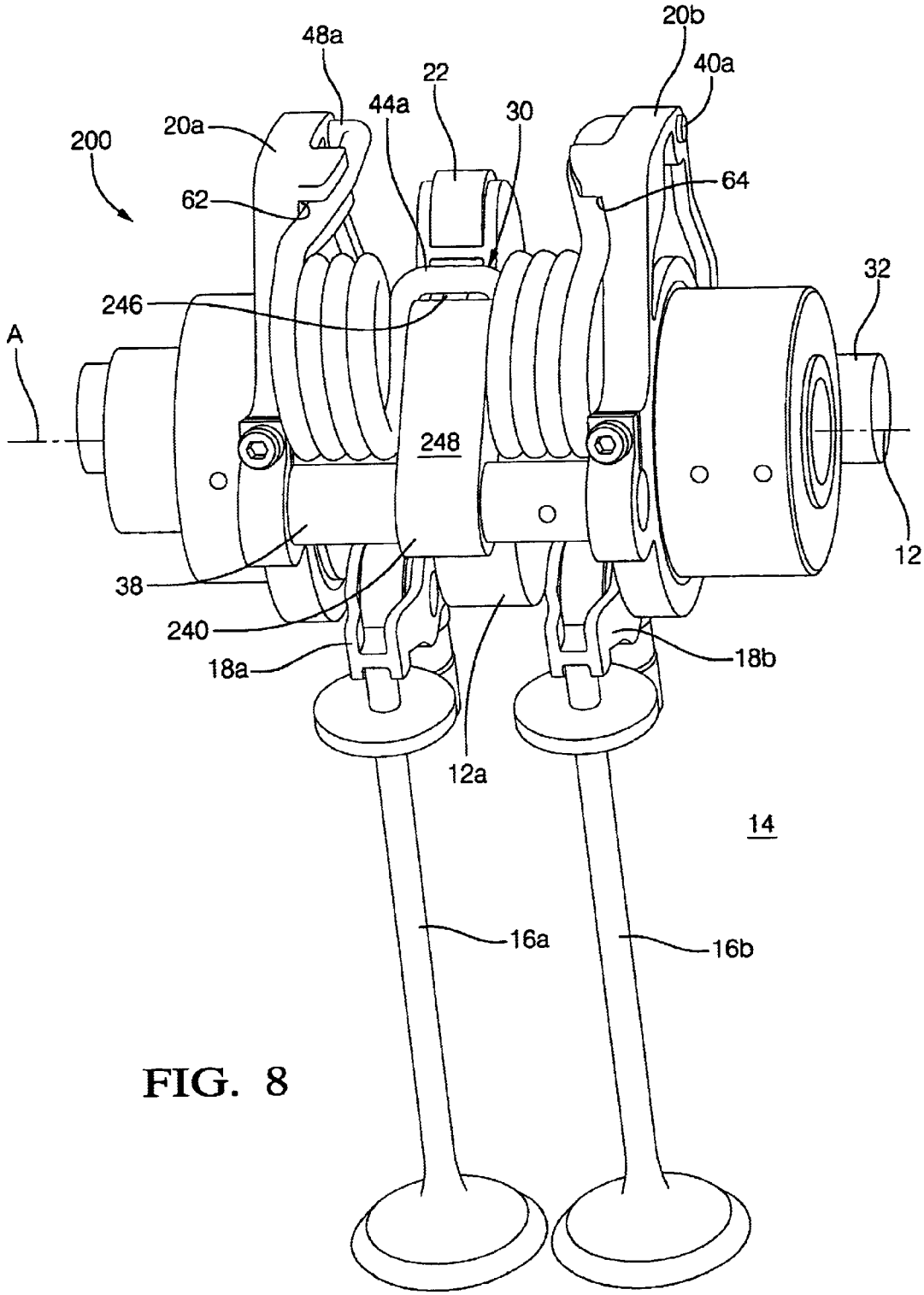
FIG. 8 is a perspective view of a third embodiment of the VVA mechanism of the present invention.

Referring now to FIG. 8, a third embodiment of a variable valve mechanism of the present invention is shown. VVA 200 is generally similar to VVA 10 and 100. In this embodiment, however, lash/return spring 30 engages groove portion 246 of rocker arm assembly 240 directly on a side 248 of rocker arm assembly 240 furthest from camshaft 12, and thereby indirectly biases rocker arm assembly 240 in a direction toward camshaft 12 to thereby maintain cam follower 36 in contact with input cam lobe 12*a*. Rocker arm 240 defines a groove 246 that is generally parallel relative to central axis A of camshaft 12, and in which bridge section 44*a* of lash/return spring 30 is disposed.

In the embodiment shown, frame members 20*a* and 20*b* are coupled together by eccentric rocker-to-frame pin 38. However, it is to be understood that the present invention can be alternately configured, such as, for example, with a non-eccentric rocker-to-frame pin.

In the embodiment shown, VVA mechanism 10 is configured with a single lash/return spring 30 that is grounded to each of the frame members and includes a central arm section that extends from each of the two coil sections of the spring. However, it is to be understood that VVA mechanism 10 can be alternately configured, such as, for example, with two separate torsion springs each of which are grounded to a corresponding frame member. Further, it is to be understood that VVA mechanism 10 can be alternately configured, such as, for example, with a single torsion spring having only one coil section, and which is grounded to only one of the frame members.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A variable valve actuating mechanism, comprising:

first and second output cams configured for being pivotally disposed upon an input shaft;

first and second frame members configured for being pivotally disposed upon the input shaft on respective sides of an input cam lobe of said input shaft;

a link arm pivotally coupled at a first end thereof to at least one of said first and second output cams;

a rocker arm assembly pivotally coupled at a first end thereof to a second end of said link arm, said rocker arm assembly carrying at least one input cam follower configured for engaging said input cam lobe of the input shaft;

biasing means grounded to at least one of said first and second frame members, said biasing means configured for biasing said input cam follower into engagement with the input cam lobe.

2. The variable valve actuating mechanism of claim 1, wherein said first and second frame members include grounding means engaging said biasing means.

3. The variable valve actuating mechanism of claim 2, wherein said biasing means comprises at least one torsion spring.

4. The variable valve actuating mechanism of claim 3, wherein said torsion spring includes first and second arm sections each of which extend from an outer end of a corresponding one of a first and second coil sections, a central arm section extending from and interconnecting said first and second coil sections, said first and second arm sections being grounded to a corresponding one of said first and second frame members, said central arm section configured for biasing said input cam follower into engagement with the input cam lobe.

5. The variable valve actuating mechanism of claim 4, further comprising a link-to-rocker pin pivotally coupling said link arm to said rocker arm assembly, said central arm section of said spring engaging said link-to-rocker pin to thereby bias said input cam follower into engagement with the input cam lobe.

6. The variable valve actuating mechanism of claim 5, wherein said link-to-rocker pin includes opposing ends, each of said ends being disposed laterally outside of a corresponding side of an interface of said link arm with said rocker arm assembly, a respective groove defined in each of said ends, corresponding portions of said central arm section being disposed within said grooves.

7. The variable valve actuating mechanism of claim 6, wherein said central arm section of said spring comprises first and second central leg sections interconnected by a bridge section, a portion of said first and second central leg sections being disposed in a corresponding one of said grooves in said link-to-rocker pin.

8. The variable valve actuating mechanism of claim 4, wherein said input cam follower comprises a roller, said roller coupled to said rocker arm assembly by a roller pin, said central arm section of said spring engaging said roller pin to thereby bias said roller into engagement with the input cam lobe.

9. The variable valve actuating mechanism of claim 8, wherein said roller pin includes opposing ends, each of said ends being disposed laterally outside of a corresponding side of said rocker arm assembly, a respective groove defined in each of said ends, corresponding portions of said central arm being disposed within said grooves.

10. The variable valve actuating mechanism of claim 9, wherein said central arm section of said spring comprises first and second central leg sections interconnected by a bridge section, a portion of said first and second central leg sections being disposed in a corresponding one of said grooves in said roller pin.

11. The variable valve actuating mechanism of claim 4, further comprising a groove defined by said rocker arm assembly, said groove disposed on a side of said rocker arm assembly that is furthest from the input shaft, said central arm section of said spring being disposed at least partially within said groove to thereby bias said rocker arm assembly in a direction toward the input cam lobe.

12. The variable valve actuating mechanism of claim 11, wherein said central arm section of said spring comprises first and second central leg sections interconnected by a bridge section, at least a portion of said bridge section being disposed within said groove in said rocker arm.

13. The variable valve actuating mechanism of claim 4, further comprising respective frame orifices defined by said first and second frame members, said spring further comprises respective ends extending from said first and second arm sections thereof, each of said ends being disposed within a corresponding one of said frame orifices.

14. The variable valve actuating mechanism of claim 13, further comprising respective slots defined by said first and second frame members, at least a portion of said first and second arm sections of said spring being received within a corresponding one of said slots.

15. An internal combustion engine, comprising:

an input shaft having an input cam lobe;

a control shaft; and a variable valve actuating mechanism, including:

at least one output cam pivotally disposed upon said input shaft;

first and second frame members pivotally disposed upon said input shaft on respective sides of an input cam lobe of said input shaft;

a link arm pivotally coupled at a first end thereof to at least one of said at least one output cam;

a rocker arm assembly pivotally coupled at a first end thereof to a second end of said link arm, said rocker arm assembly carrying at least one input cam follower, said input cam follower engaging said input cam lobe; and biasing means grounded to at least one of said first and second frame members, said biasing means biasing said input cam follower into engagement with said input cam lobe.

16. The internal combustion engine of claim 15, wherein said first and second frame members include grounding means engaging said biasing means.

17. The internal combustion engine of claim 15, wherein said biasing means is a torsion spring.

18. The internal combustion engine of claim 17, wherein said torsion spring includes first and second arm sections each of which extend from an outer end of a corresponding one of a first and second coil sections, a central arm section extending from and interconnecting said first and second coil sections, said first and second arm sections being grounded to a corresponding one of said first and second frame members, said central arm section biasing said input cam follower into engagement with said input cam lobe.

19. The internal combustion engine of claim 18, further comprising a link-to-rocker pin pivotally coupling said link arm to said rocker arm assembly, said central arm section of said spring engaging said link-to-rocker pin to thereby bias said input cam follower into engagement with said input cam lobe.

20. The internal combustion engine of claim 19, wherein said link-to-rocker pin includes opposing ends, each of said ends being disposed laterally outside of a corresponding side of an interface of said link arm with said rocker arm assembly, a respective groove defined in each of said ends, corresponding portions of said central arm section being disposed within said grooves.

21. The internal combustion engine of claim 20, wherein said central arm section of said spring comprises first and second central leg sections interconnected by a bridge section, a portion of said first and second central leg sections being disposed in a corresponding one of said grooves in said link-to-rocker pin.

* * * * *